United States Patent [19]

Roussin

[11] Patent Number: 4,724,359

[45] Date of Patent: Feb. 9, 1988

[54] LAMINAR FLOW GUNS FOR LIGHT VALVES

[75] Inventor: Alfred G. Roussin, Syracuse, N.Y.

[73] Assignee: General Electric Company, Princeton, N.J.

[21] Appl. No.: 920,005

[22] Filed: Oct. 17, 1986

[51] Int. Cl.[4] ..... H01J 29/46; H01J 29/56

[52] U.S. Cl. ..... 315/15; 358/62; 313/453

[58] Field of Search ..... 315/14, 15; 358/62; 313/414, 448, 453; 350/356

[56] References Cited

U.S. PATENT DOCUMENTS

| | | | |
|---|---|---|---|
| 3,151,269 | 9/1964 | Vestal | 313/453 |
| 3,256,460 | 6/1966 | Wendt | 313/453 |
| 3,409,735 | 11/1968 | Campbell et al. | 358/62 |
| 3,740,607 | 6/1973 | Silzars et al. | 313/453 |
| 3,881,136 | 4/1975 | Scheele | 313/453 |

*Primary Examiner*—Theodore M. Blum
*Attorney, Agent, or Firm*—Eugene M. Whitacre; Vincent J. Coughlin, Jr.

[57] ABSTRACT

A laminar flow electron gun (16) for use in a light valve of the Schlieren dark field type is disclosed. The gun uses three accelerating electrodes (111, 112 and 113) with critical axial spacing to beam diameter ratios to allow independent adjustment and/or modulation of beam current density at the imaged aperture while reducing criticality of electrode voltages on the second and third accelerating electrodes. The design permits, but does not require, the use of a separate control grid electrode (110). The first accelerating electrode (111) is closely spaced to the cathode (119) to provide a virtual cathode at, or about, the voltage level of that electrode that reduces the thermal beam spread normally encountered in conventional electron guns. Primary control of the narrow angle beam current is by adjustment of the beam current density impinging on the final aperture (121) in the gun. The interaction of negative and positive electron lenses within the gun retains laminar flow conditions to the final aperture over a wide range of beam current levels, assuring low beam spread in the output beam from the gun.

11 Claims, 12 Drawing Figures

$I_K = 5.25$ mA
$I_{A1} \simeq 2.8$ mA
$I_{A2} \simeq 1.8$ mA
$I_{A3} + I_0 \simeq 0.58$ mA
$I_0 = 4.8\,\mu A$ $P_{A1} = .23$ W
$P_{A2} = 4.38$ W
$P_{A3} = 4.18$ W CHANGING $A_1$ VOLTAGE TO CHANGE CURRENT DENSITY RESULTS IN $A_1$ TO $A_2$ FIELD STRENGTH CHANGE - CANCELLING EFFECT OF $\Delta A_1$ VOLTAGE $I_K = 5.25$ mA $I_{A1} \simeq 2.8$ mA $I_{A2} \simeq 1.8$ mA $I_{A3} + I_0 \simeq 0.58$ mA $I_0 = 4.8\,\mu$A $P_{A1} = .23$ W $P_{A2} = 4.38$ W $P_{A3} = 4.18$ W

TRAJECTORIES FOR 2D MODEL

LAMINAR FLOW GUNS FOR LIGHT VALVES

BACKGROUND OF THE INVENTION

1. Field of the Invention

The present invention generally relates to improvements in light valve projection systems of the Schlieren dark field type and, more particularly, to an improved electron gun for the light valve to achieve improvements in the depth of focused field of the electron beam and a reduction in beam spread and off-axis aberrations of the beam, as well as less criticality in mechanical alignment of electro-optical parts and applied voltages.

2. Description of the Prior Art

Light valve projection systems of the Schlieren dark field type have been in commercial use for many years and are capable of providing excellent performance. Typical prior art color projection systems of this type are shown in U.S. Pat. Nos. 3,290,436, 3,352,592 and 3,437,746, all of which were issued to W. E. Good et al. The principles of operation of this type of projection system are briefly described with reference to FIGS. 1, 2 and 3 of the drawings.

With reference first to FIG. 1, there is schemetically shown a single-gun television light valve assembly comprising a lamp 10, sealed light valve 12, and Schlieren projection lens 14. The sealed light valve 12 comprises a glass envelope which contains an electron gun 16, input slots 18, focus-deflection system 20, a control layer 32 on a rotating disk 22, and a fluid reservoir 24. A specific example of an electron gun used in light valves of the Schlieren dark field type is disclosed in U.S. Pat. No. 3,586,901 to Findeisen.

The electron gun 16 generates, from anode aperture 11, an electron beam which is used to "write" charge patterns on the control layer 32. It should be understood that disk 22 is made of glass and, on the side facing electron gun 16, has a transparent electrode surface which is electrically connected to a source of positive potential with respect to the cathode of the light valve. Disk 22, and its transparent electrode, are coated with a layer of deformable fluid which is the control layer 32. Electron charge patterns from the electron beam are deposited on the surface of the control layer 32 and are acted upon by the electric field from the disk electrode to deform the surface of the control layer, forming diffraction gratings. The electron beam is focused, deflected and modulated to control the fluid surface deformations which control the light rays passing through the layer 32 and disk 22.

The focus-deflection system 20 comprises three electrode sets each having four orthogonal electrodes, which form three electrode "boxes", referred to as boxes 23, 25 and 27, and a cylindrical electrode 21. The first of these, box 23, is arranged about the aperture in the input window and serves to center and allow predeflection of the electron beam. The next two boxes, boxes 25 and 27, have DC and AC voltages applied to them in a manner to achieve a uniformly focused electron beam image of aperture 11 which is scanned across the raster plane on control layer 32. This, in turn, permits the control layer fluid to be modulated uniformly by charge control to produce a uniformly colored projected image. following the focus-deflection boxes 25 and 27 is a drift ring 21 which serves, with a transparent electrode on disk 22, as an element of the final electron lens in the focus-deflection system 20.

Specific examples of light modulating fluids are disclosed in U.S. Pat. No. 3,288,927 to Ralph W. Plump, U.S. Pat. Nos. 3,317,664 and 3,317,665 both to Edward F. Perlowski, Jr., U.S. Pat. No. 3,541,992 to Carlyle S. Herrick et al, and U.S. Pat. No. 3,761,616 issued to C. E. Timberlake. These fluids may include additives as taught by U.S. Pat. Nos. 3,764,549 and 3,928,394 to David A. Orser. In general, the control layer or light modulating fluid is a very special chemical compound, modified with special additives, having the electromechanical and visco-elastic properties needed to produce effective control layer properties in the electron beam addressed light valve.

The basic light collection system includes an arc lamp 10, which may be a Xenon lamp, the arc of which is located at the focus of a reflector system, which may be a simple ellipsoidal reflector, as shown, or a compound reflector, as disclosed for example in U.S. Pat. No. 4,305,099 to Thomas T. True et al. The light from the arc is reflected from the reflector through a pair of spaced lens plates having corresponding pluralities of rectangular lenticules arranged in horizontal rows and vertical columns. The first lens plate is shown in FIG. 1 at 28 and the second lens plate is formed on the light input surface of the glass envelope of the light valve 12. The light from the lamp 10 is projected through a color filter plate 26 and the lenticular lens 28 before entering the light valve 12.

The interior surface of the glass envelope of the light valve 12 carries the input light mask in the form of slots 18 which, for example, may be applied by vapor deposition. The input slots 18 are a series of transparent slots and alternating opaque bars in a pattern generally as indicated in FIG. 1. The filtered light rays from the lamp 10 pass into the light valve 12 through these transparent slots. The lenslets of the lenticular lens 28 and the corresponding lenslets, formed on the light input surface of the glass envelope of the light valve 12, form condensing lens pairs which first focus spots of filtered light onto the slots of the light mask and then re-image the light rays onto the control layer raster plane 32. With this arrangement, efficient utilization is made of light from the arc lamp, and uniform distribution of light is produced, in a rectangular pattern, on the light modulating medium or control layer 32.

The Schlieren projection lens 14 includes Schlieren lens elements 29, output color selection bars 30 and a projection lens system 31. The output selection bars 30 are the complement of the input slots 18. That is, on the output bar plate, the bars are optically aligned with the slots of the input slots 18 so that, in the absence of a diffraction of light passing through the control layer 32, light rays are focused and terminated on the bars of the output bar plate. This creates a "dark field" condition, i.e., no light is transmitted in the absence of a modulating signal superimposed on the raster scanning signals applied to the horizontal and vertical deflection plates of the deflection system 20. It should be noted, however, that the electron beam which scans the raster and provides charge to the control layer is a constant current electron beam, there being no modulation of the intensity of the beam produced by the electron gun 16 (other than during the horizontal and vertical retrace intervals when the beam is off).

The lower half of FIG. 1 shows the cross sections of the light body and light valve components. The spectral diagrams at the bottom indicate how the light is prefiltered before entering the light valve.

FIG. 2 is a simplified light valve diagram showing the color selection action of the three basic gratings. The control layer 32 which is supported by the rotating disk 22 (shown in FIG. 1) is illustrated as having three different diffraction gratings for red, green and blue light components. These diffraction gratings may be written individually or simultaneously and normally are actually superimposed but, for purposes of illustration only, they are shown in FIG. 2 as separated on the control layer 32.

In the light valve projection system shown in FIGS. 1 and 2, green light is passed through the horizontal slots of the input bar plate 18 and is controlled by diffraction gratings formed by modulating the height of the scanned raster lines on the control layer 32. This is done by controlling the amplitude of a high frequency carrier applied to the vertical deflection plates as modulated by the green video signal as shown in FIG. 3. Magenta (red and blue) light is passed through the vertical slots of the input bar plate 18 and is controlled by charge generated diffraction gratings created at right angles to the raster lines by velocity modulating the electron spot as it is scanned in the horizontal direction. In the example shown in FIG. 3, this is done by applying a 16 MHz (12 MHz for blue) signal to the horizontal deflection plates and modulating it with the red video signal as shown in FIG. 3. The grooves created in the control layer 32 have the proper spacing to diffract the red portion of the spectrum through the vertical output slots in plate 30 while the blue portion is blocked. (When the 12 MHz carrier is used, the blue light is passed by the vertical slots in plate 30 and the red light is blocked.)

Thus, three simultaneous and superimposed primary color pictures can be written with the same electron beam and projected to the screen 33 as a completely registered full color picture. Colors are created by writing miniature diffraction gratings within each picture element on the fluid surface by manipulating the single scanning electron beam. These gratings diffract the transmitted light rays away from their terminations at the output bars where they are spatially filtered to let the desired color reach the screen. The amount of light diffracted is dependent on the depth of the gratings formed in the control layer. This technique permits a full color television picture to be written on a single control layer with no need for further registration.

FIG. 3 shows in block diagram form the basic light valve projector circuitry. A composite video signal is supplied to the input of a decoder 34 which provides at its output red, blue and green video signals. These signals are respectively applied to modulators 36, 38 and 40. A grating generator 42 supplies carrier signals which, in the case illustrated, have frequencies of 16 MHz and 12 MHz, respectively, to modulators 36 and 38 and a signal having a frequency of 48 MHz to modulator 40. The outputs of the red and blue modulators 36 and 38 are combined and superimposed on the horizontal deflection signal from the horizontal deflection signal generator 44. The output of the green modulator 40 is superimposed on the vertical deflection signal from the vertical deflection generator 46.

The basic Schlieren dark field light valve projector as schematically illustrated in FIGS. 1, 2 and 3 has evolved over a period of years to be a highly efficient projector producing excellent quality pictures of good color balance and high resolution. There is, however, an ongoing effort to improve and optimize the design and operation of the projector. Among the more critical design considerations is the electron optics of the light valve. The electron optics are, as may be appreciated from the foregoing discussion, quite complex and dynamically changing as a result of the varying deflection voltages.

It has been found that with very exact alignment of the light valve's focusing and deflecting electrode system and with critically close control of applied voltages, sweep balance and dynamic pre-deflection, reasonably acceptable video writing performance can be obtained. Even with the aforementioned concerns under careful control, prior art electron optics have required operational compromises to be made in balancing the many variables of electrical and mechanical properties of the light valve system for best performance. Accordingly, there is a continuing need to optimize and improve the uniformity of the modulated color fields of the projected images and to decrease the sensitivity of the mechanical assembly and alignment of the electron optics electrode system.

The present invention approaches optimization of the design of the light valve by making improvements in the electron gun. Electron guns known in the prior art include those disclosed in the following U.S. patents.

U.S. Pat. No. 2,888,605 to Brewer discloses a system which forms a "collimated flow of electrons" that converges electrons through an accelerating electrode 32 and then through a drift ring cylindrical electrode 20 to reduce transverse velocity components and increase the lateral velocity. A range of voltages of 1.1 to 1.5 is identified. No beam shaping aperture is used. The cylindrical electrodes fields create a drift space but do not intercept portions of the cathode emitted beam.

U.S. Pat. No. 2,909,704 to Peter discloses a system which produces a divergent beam from the cathode. This is achieved with a first positive aperture anode, B, and a negative focusing ring, A. voltages applied to these two electrodes cause the divergent beam to be focused into a "parallel" flow. Subsequent anodes have aperture diameters substantially greater than the diameter of the cathode electrode and the voltages of the first two accelerating electrodes are of the same order. Additionally, the focusing electrode surface is behind the plane of the cathode. The objective of Peter's gun design is to produce a "low noise" electron beam by minimizing axial velocity spread. This is accomplished with the use of large anode apertures which do not intercept significant portions of the electron beam. Peter generates a beam which is from one to four times the diameter of his cathode.

U.S. Pat. No. 3,349,269 to Hamann discloses a system that employs converging beam crossovers in a cathode ray tube that is used to generate alphanumeric characters. The electron beam is used to flood a beam shaping matrix which forms the alphanumeric characters, and the resulting beam is deflected by two pairs of cylindrical lenses to the desired target position. The electron gun does not produce a laminar flow with minimum beam angle.

U.S. Pat. No. 3,417,194 to Yoshida et al discloses a cathode ray tube which seeks to reduce beam spread by compensating for the defocusing effect of relatively high video modulation voltages which are applied to the electron gun grid-cathode region. There is no generation of laminar or parallel flow of the electron beam. Grid electrode apertures are of the same or larger diameter as distance from the cathode is increased.

U.S. Pat. No. 3,586,901 to Findeisen discloses an electron gun of the general type which has been used in light valves of the type described. This gun is a beam cross-over type using a beam shaping anode aperture to shape the emitted electron beam. It further uses a small "potential hill" field, downstream from the cathode, grid and apertured anode, to reduce the number of positive ions which can reach the aperture and emitter. These positive ions result from the electron beam bombarding the control layer on the rotating disk of the light valve.

U.S. Pat. No. 3,740,607 to Silzars discloses a laminar flow electron gun which provides a small beam with high current density. This is accomplished by using long focal length lenses without limiting apertures and seeks to establish the screen spot size by imaging the virtual cathode of the gun with converging lenses. The aperture used in the gun anodes are substantially larger than the diameter of the beam. There are no beam intercepting apertures in Silzers' gun nor is the beam shaped by current limiting apertures.

U.S. Pat. No. 3,924,153 to McIntyre discloses an electron gun which seeks to prevent beam spread by using an axial cylindrical electrode surrounding the grid to anode region of the gun to reduce radial velocity components of the beam. While McIntyre does use a beam limiting aperture, there is nothing about the design that would produce a laminar flow and minimize the beam spread angle nor is there any use of multiple apertured anodes which shape the beam's cross-section. Further, the aperture used is not imaged to the target.

U.S. Pat. No. 3,980,919 to Bates et al discloses the formation of a sheet beam. The effects of asymmetries are minimized by avoiding small apertures and using long focal length lenses through the central portion of the lenses in the gun. Apertured electrodes are used to create needed accelerating fields, but they do not intercept or limit the beam. None of the apertures are imaged to the target.

U.S. Pat. No. 4,467,243 to Fukushima et al discloses an electron gun which uses an apertured grid and anode in which the diameter of the first aperture is smaller than or equal to the diameter of the second aperture. By this means, there is formed a uniform axial field and a laminar flow electron beam of constant current density is generated. The spot size and shape is produced by magnetic focus, not by an aperture.

U.S. Pat. No. 4,481,445 to Gorski teaches a bipotential electron gun which generates a cross-over beam establishing fields through a series of apertured electrodes of increasing aperture diameter from the cathode.

U.S. Pat. No. 4,496,877 to Kueny teaches a gun construction which tries to counter the beam spread angle effects of a first cross-over with field shaping electrodes and voltages. Apertures are used for beam focusing field formation and not beam interception. Aperture diameters are the same or larger as distance from the cathode increases.

SUMMARY OF THE INVENTION

It is therefore a general object of this invention to provide improvements which optimize the design and manufacture of light valve projection systems of the Schlieren dark field type.

It is another more specific object of the invention to provide an improvement in the electron gun of the light valve which improves the uniformity of the projected modulated video fields.

It is a further object of the present invention to provide an improvement in the electron gun which minimizes electrode spacing criticality and minimizes applied voltage criticality in light valves of the Schlieren dark field type.

According to the invention, an improved electron gun has been developed to provide an electron beam of minimum beam angle, for given values of cathode temperature and anode voltage which, in turn, provides minimum off-axis deflected electron beam aberrations and improved depth of field of the electron optically focussed image of the anode aperture. This invention provides a laminar flow electron beam, with controllable beam current density, having a power efficient beam accelerating and shaping electrode system that is particularly adapted for use in a light valve of the Schlieren dark field type. The electron gun according to the invention comprises a cathode capable of high constant current emission operating at a cathode temperature of about 2000° K. A cathode temperature range of 1200° K. to 3000° K. may be used with various emitter materials. Multiple apertured accelerating electrodes are used to form the laminar flow beam. All these electrodes control or intercept portions of the current emitted by the cathode, removing most of the electrons that have high lateral velocity vectors and, because the intermediate electrodes operate at lower than final beam shaping aperture voltage, reduce the gun power requirement that otherwise would create thermal problems within the gun and waste high voltage power. The apertures deployed axially from the cathode are of successively smaller areas. In contrast, prior art electron guns attempt to obtain laminar flow with successive lenses through the same or larger aperture diameters. Light valves of the Schlieren dark field type, however, use the final aperture to set the beam shape that is imaged on the control layer, requiring low beam spread angle to minimize spot aberration distortion in the deflected beam. The subject invention achieves a low beam spread angle at high constant beam current density and low voltages without a constraining magnetic field.

The laminar flow electron gun for light valves of the present invention is distinguished from the prior art mentioned above by the use of a flat cathode, grid and at least two, preferrably three, accelerating anodes. The grid and all accelerating anodes are on axis with the cathode electrode, and all are apertured with successively smaller area apertures. Electrostatic fields created by the voltages applied to these apertured electrodes cause electrons to move from the cathode through the electron gun in an essentially laminar flow manner to minimize beam spread angle in the beam passed through the beam shaping aperture. In this gun design, the beam current density is achieved without use of a beam cross-over point to concentrate electron charge. This gun is unlike most prior art guns in which the cross-over point, with its high transverse velocity electrons, is imaged to the final collecting electrode to form a high density focused spot. Rather, the electron beam is shaped at the beam shaping aperture, and the high current density shaped beam with low beam spread coming through the aperture is then imaged, electron optically, to the fluid layer of the rotating disk of the light valve.

BRIEF DESCRIPTION OF THE DRAWINGS

The foregoing and other objects, aspects and advantages of the invention will be better understood from the following detailed description with reference to the drawings, in which.

DETAILED DESCRIPTION OF THE PREFERRED EMBODIMENT OF THE INVENTION

Figure 4:
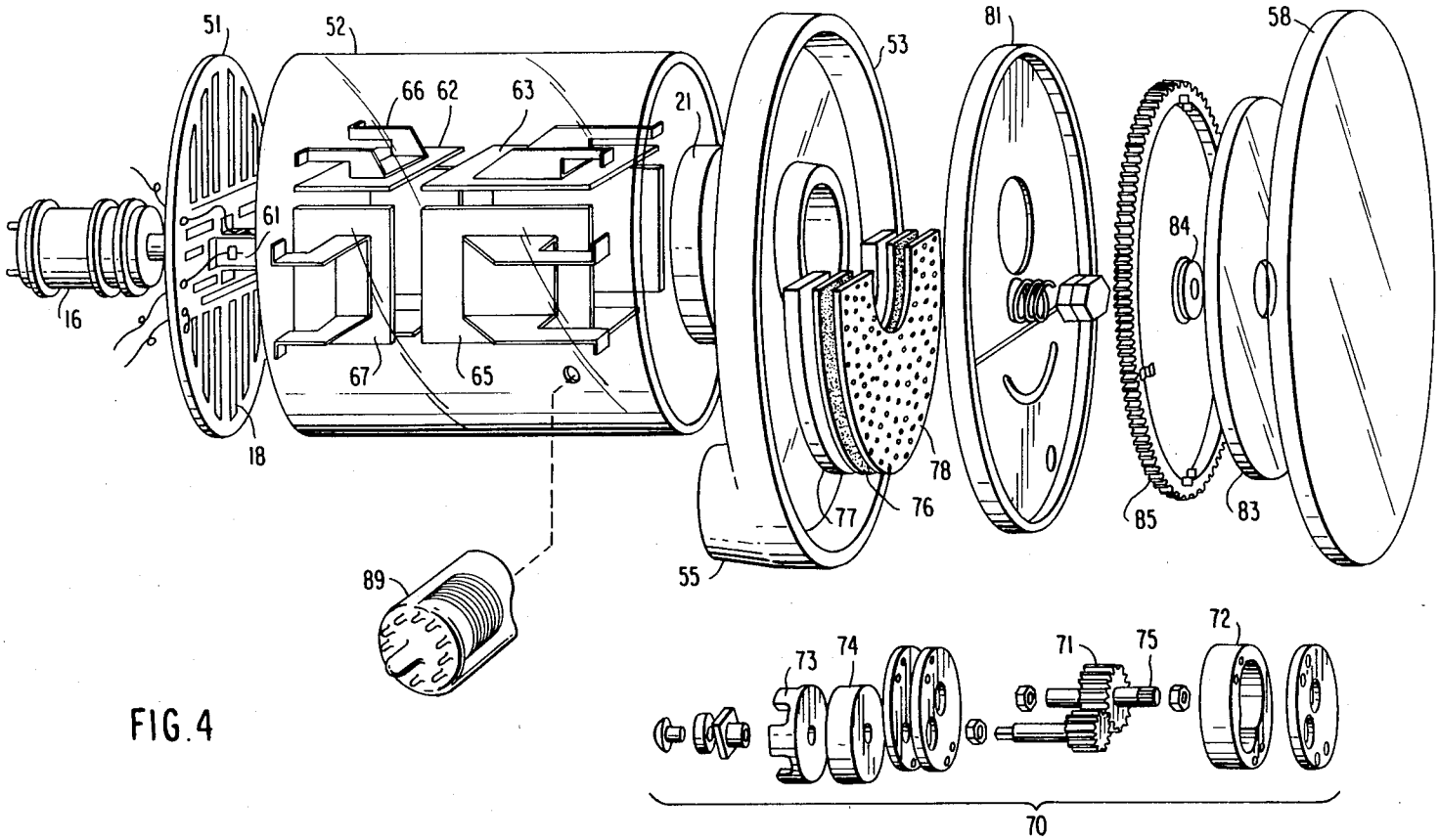
FIG. 4 is an exploded perspective view of major elements of a new generation of light valves which embody the invention.

In the drawings, like reference numerals used in the several figures indicate the same or corresponding components. Referring again to the drawings, and more particularly to FIG. 4, there is shown an exploded view of the internal vacuum components of the new generation Schlieren dark field light valves. The vacuum enclosure comprises an input window 51, a focus deflection cylinder 52, a rear housing 53 which has a molded recess 55 for receiving a pump assembly 70, and a face plate 58. The electron gun assembly 16 is attached to a central aperture of the input window 51, and the input slots or bar plate 18 are formed on the interior surface of the input window 51, functionally similar to the earlier light valves of this type.

The focus and deflection assembly comprises three sets of electrodes. One set of four electrodes 61, comprising a pair of horizontal plates and a pair of vertical plates, is attached to the input window 51 about its central aperture. A pair of vertical deflection plates 62 and a pair of horizontal deflection plates 67 located within the cylinder 52 form the second set. The third set is comprised of the vertical deflection plates 63 and the horizontal deflection plates 65. As shown in FIG. 4, the deflection plates 62, 63, 65, and 67 are supported within the cylinder 52 by means of brackets 66 which also provide the electrical connections to the deflection plates. Beyond the deflection plates 63 and 65 and within the rear housing 53 is a cylindrical drift ring 68 which, with a transparent electrode on disc 83, completes the focus-deflection system.

Figure 1:
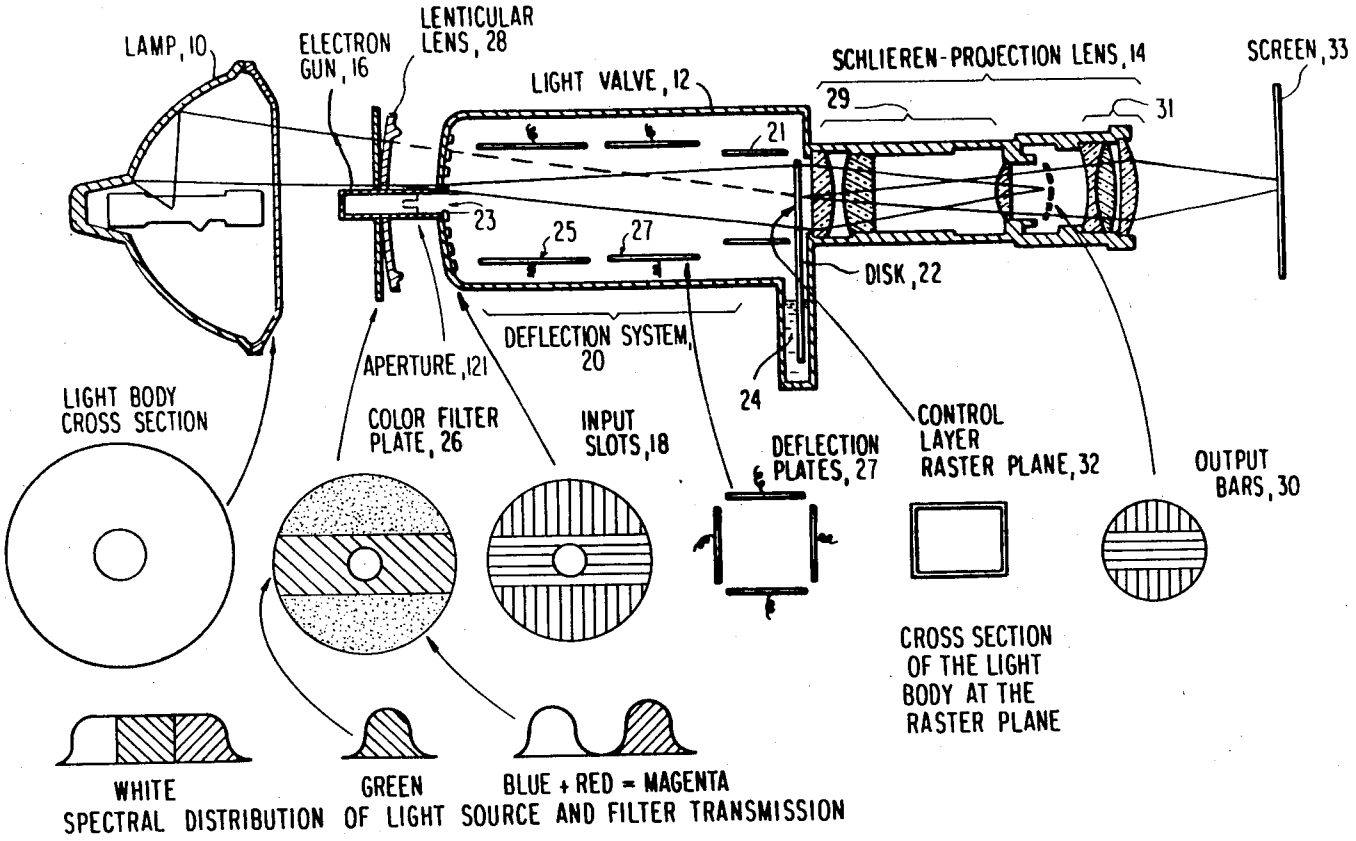
FIG. 1 PRIOR ART
FIG. 1 is a simplified cross-sectional view showing the construction of a prior art light valve projection system.
Figure 2:
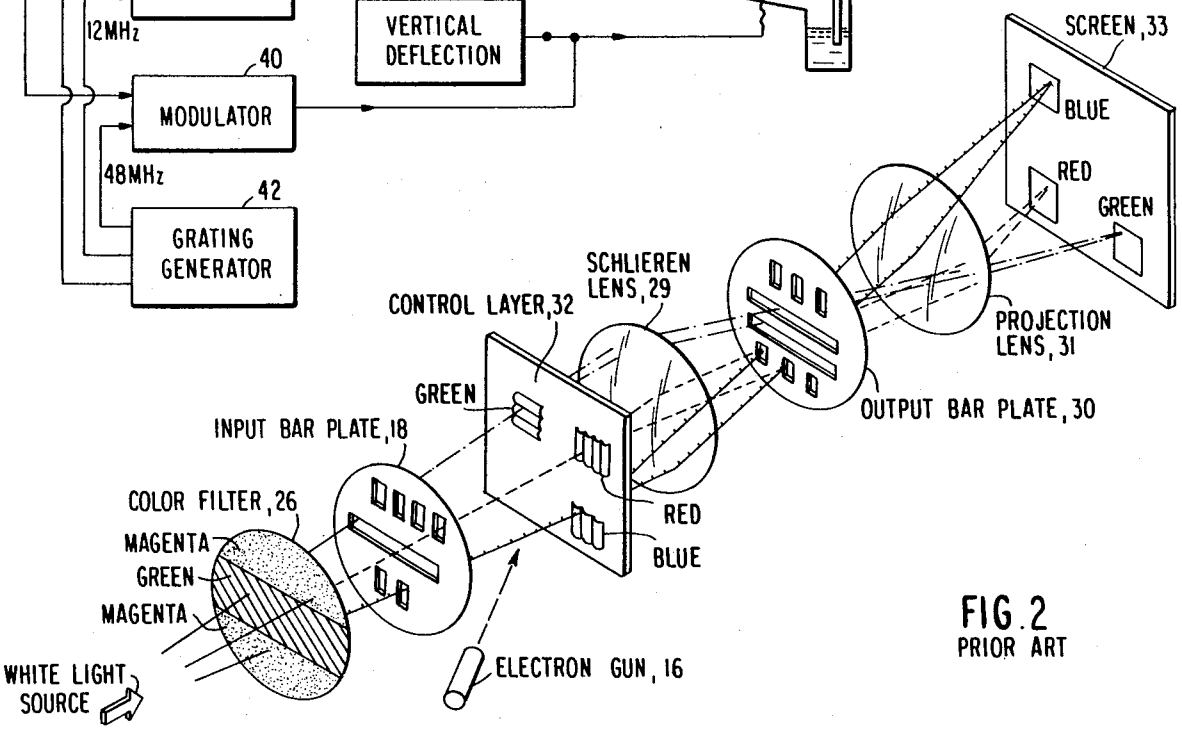
FIG. 2 PRIOR ART
FIG. 2 is a simplified perspective view illustrating the principles of operation of the prior art light valve projection system.
Figure 3:
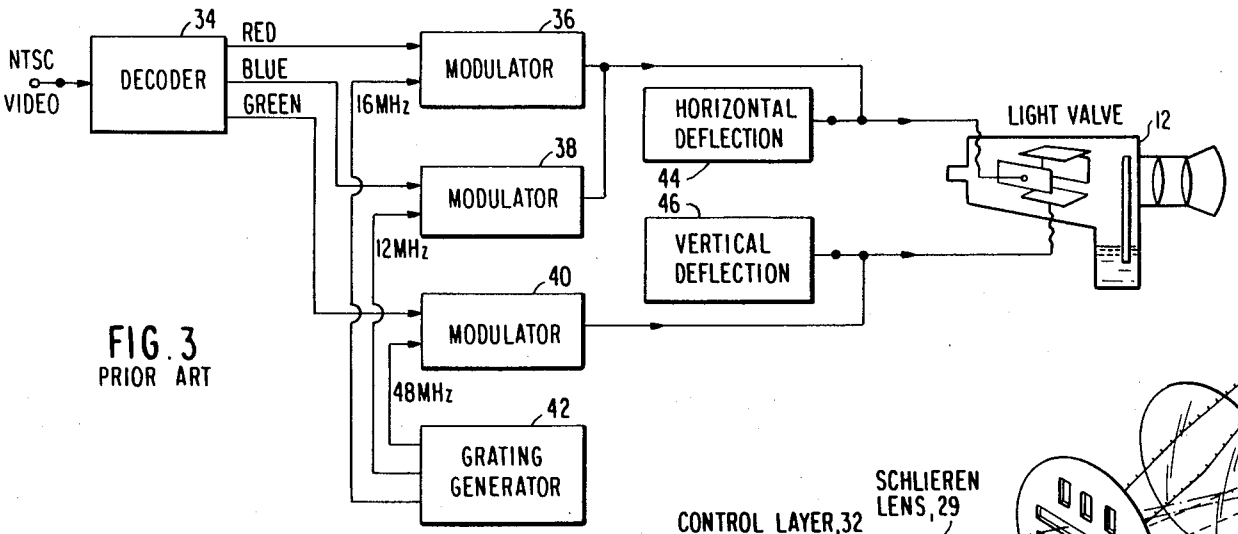
FIG. 3 PRIOR ART
FIG. 3 is a block diagram showing the basic circuitry of a modulated deflection system of the prior art light valve projection system.

A gear pump assembly, generally indicated at 70, is located within recess 55 of the rear housing 53. The gear pump comprises gears 71 within a housing 72 driven by a magnet 73. The magnet 73 is coupled to a rotating magnet driven by an electric motor (not shown) axially aligned with the pump 70 on the exterior rear face of the recess 55 that houses the pump. An axial shield 74 is provided for the magnet 73 so that its magnetic field does not affect the electron beam. Other magnetic shielding is provided within the light valve projection system to prevent the electron beam from being affected by magnetic fields at the projector or due to the earth's magnetic field. The rear housing 53, including the recess 55 which houses the pump assembly 70, and the face plate 58 generally define the reservoir 24 (schematically illustrated in FIG. 1) which contains the fluid. The gear pump 70 is located in that reservoir and operates to pump the fluid through a filter 76. The filter 76 is sandwiched between a filter housing 77 and a perforated panel 78, and this assembly is secured to the lower rear face of a baffle 81. The baffle 81 is a generally circular disk with a forwardly projecting flange which surrounds the rotating disk 83. The disk 83 is supported for rotation by a bearing 84 through which projects a pin mounted in the center of baffle 81. A ring gear 85 is attached to the peripheral edge of the disk 83 and is driven by a pinion gear 75 that projects from the gear pump 70.

Attached to the side of the cylinder 52 is a vacuum maintenance device 89, which collects gaseous materials remaining in the envelope after it is sealed and which are generated as a product of the operation of the light valve.

Figure 5:
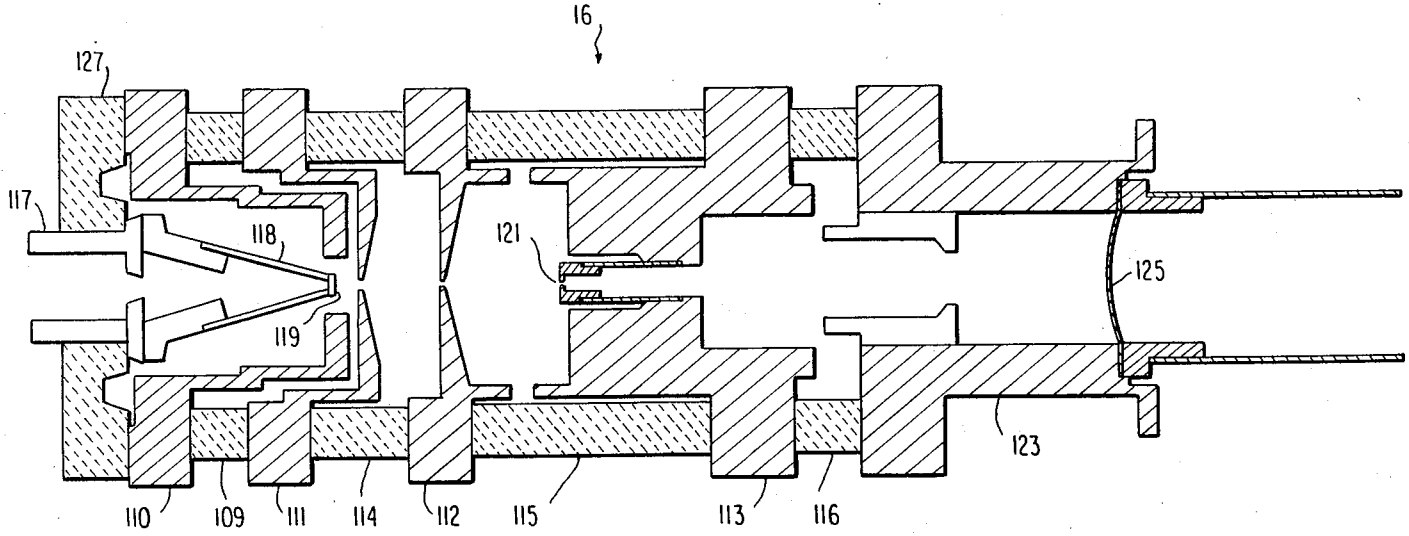
FIG. 5 is a cross-sectional view of the improved electron gun according to the invention showing a multiplicity of axially dispersed apertured electrodes.

Referring now to FIG. 5, the electron gun 16 includes an electrically heated cathode 119 supported by heater legs 118 that are attached to connectors 117 which are mounted in and pass through insulating disk 127. A grid 110 coaxially aligned with and adjacent the cathode 119 is held in place between the insulating disk 127 and an insulating spacer 109. Four coaxially aligned apertured electrodes 111, 112, 113, and 123 are held in coaxial spaced relation by insulators 109, 114, 115, and 116, and the gun is enclosed by sealing diaphragm 125. The purpose of the diaphragm 125 is to seal the electron gun to allow its testing prior to assembly in the light valve. After the light valve has been assembled with the still sealed but tested electron gun in the input window, the diaphragm 125 is removed by means of a laser beam thereby connecting the vacuum space of the light valve with the internal volume of the electron gun and permitting the passage of the electron beam into the focus and deflection system (20 in FIG. 1) of the light valve.

The function of the electron gun in the light valve system is to generate a tiny, generally rectangularly shaped electron beam which can be used to deposit charge patterns on the control layer of the light valve. Electrons from the cathode 119 are attracted toward anode 113 by electrostatic fields created by the shaping and spacings of electrodes 111, 112 and 113 and by the application of suitable voltages on these electrodes. Anode 113 has a rectangularly apertured component 121 which allows a portion of the electron beam to pass into the region of electrode 123 and diaphragm 125.

An objective of this invention is to generate a high current density electron beam of minimum beam angle to provide maximum depth of focus of the electron optically imaged object aperture and also to minimize off-axis beam aberrations at the target plane of the raster scanned beam. A further objective is to provide an electron gun whose electron beam current can be controlled in amplitude, but whose beam angle is relatively insensitive to control beam current and/or voltage changes. Prior art electron guns generally utilized accelerating and focusing fields to create a high current density region in which cathode emitted electrons are conveyed to a crossover point and then imaged from the crossover to the target electrode of the electron discharge device. This permitted utilization of relatively low cathode current density emitters in devices requiring relative high beam current density. However, attempts to obtain the desirable beam properties of laminar electron flow from such guns generally required the use of high voltages in electron lenses of long focal lengths to keep these crossover imaged beams from diverging due to high crossover entrance angles of off-axis electrons and from thermal and mutual repulsion forces of the beam.

It has been determined that deflected or off-axis beam aberations increase as the third power of beam angle. Further, it can be shown that electron beam spread angle is related to the combination of axial and lateral electron velocity vectors. These relationships may be expressed as follows:

$$\text{lateral velocity} \simeq \sqrt{\frac{KTk}{e}}\text{, and}$$

$$\text{axial velocity} \simeq \sqrt{V\text{axis}}\text{,}$$

where

K is the Boltzman constant,

Tk is the absolute temperature of the cathode, e is the electron charge, and

Vaxis is the axial voltage component of the accelerating field.

For this light valve system, a beam current of about 5 microamperes is required to deliver the charge distribution to control layer 32 needed to create the appropriate diffraction gratings for efficient projection display. The uniformity of diffraction grating formations over the area scanned by the electron beam is directly proportional to the uniformity of electron optical imaging of the dimensions of the beam forming aperture 121 at the control layer. The grating uniformity, in turn, establishes the light transfer uniformity through each written element of the raster. Accordingly, the ability of the light valve to project a uniformly illuminated field of light, of any defined color, is directly related to the electron beam's size and shape at the control layer plane. Any change in magnification, focus or shape of the writing electron beam will result in a change in the light transfer. It is therefore an objective of this invention to minimize the differential effects of electron beam writing parameters by minimizing the beam angle as it exits from the rectangular aperture 121 in the electron gun. To achieve this objective, the electron gun according to the invention provides essentially laminar electron flow at the imaged aperture 121 plane, minimizing lateral velocity components in the beam and thereby, providing a beam of suitable charge density and a very low beam angle to minimize deflected beam aberrations in the light valve. The cathode of this electron gun operates at about 2000° K. to provide the desired current density of about 1.2 amperes/cm$^2$. This cathode temperature level establishes the maximum lateral velocity component of some of the electrons in the beam flowing through the anode aperture 121 and thus relates to the minimum beam spread angle. For this electron gun operating at about +7200 volts on electode 113, the thermal angle of spread has been calculated to be 0.56°.

Figure 6A:
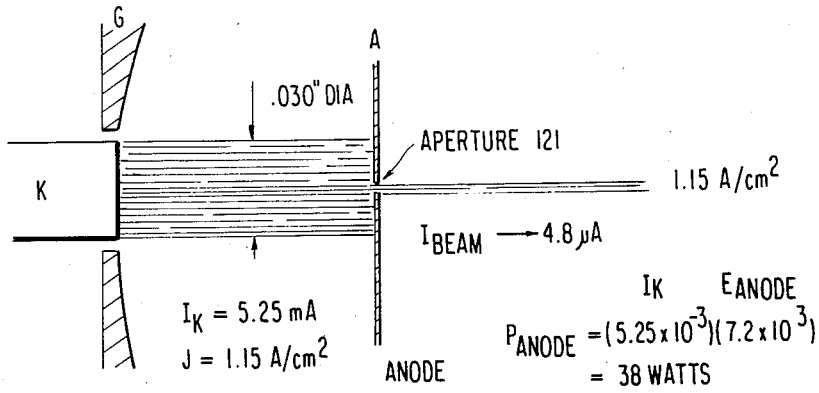
FIGS. 6A to 6D are enlarged cross-sectional views of a portion of electron guns showing various electrode configurations and illustrating the effects of electrostatic fields in establishing the desired laminar flow condition.

FIG. 6A illustrates a simple two electrode laminar flow electron gun. If the desired laminar flow conditions at aperture 121 are to be achieved, electrons flowing to electrode A from the cathode K must arrive with only axial velocity vectors, and the entire area of the apertured anode must receive current at a uniform current density. Assuming that electrode shape of the cathode K, field shaping of the grid G and anode A and the interelectrode spacings and voltages as illustrated in FIG. 6A are such that electrons emitted from the 0.030 inch diameter cathode K reach the anode electrode A to produce the desired laminar beam current density of about 1.2 amperes/cm$^2$, the power at the electron gun anode is the product of $5.25\times10^{-3}$ amperes times $7.2\times10^{3}$ volts or 38 watts to produce the desired writing beam current of $4.8\times10^{-6}$ amperes. This power level creates heating at the anode far beyond the desired range of 600° C. to 1100° C. and is wasteful of high voltage energy.

Figure 6B:
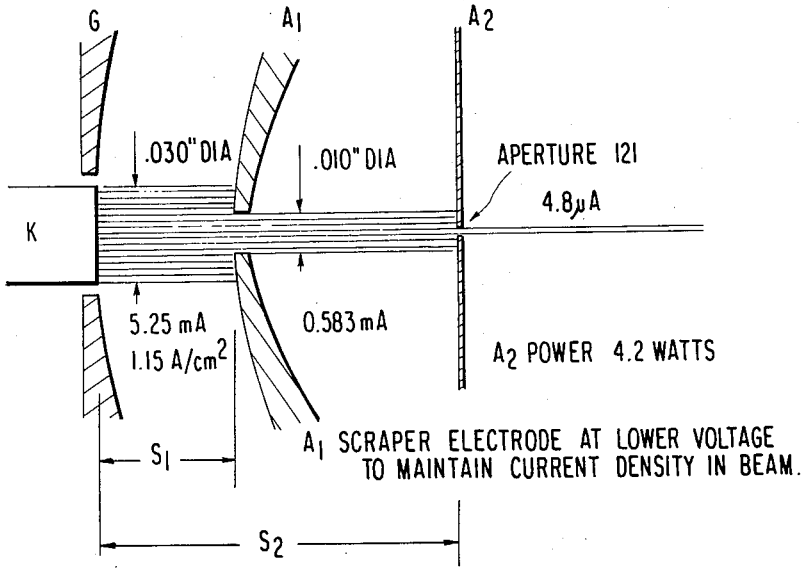

An improvement is shown in FIG. 6B wherein an auxiliary anode $A_1$ has been interposed between grid G and cathode K and the original apertured anode $A_2$. This electrode is curved to correspond to the shape of the electrostatic field equipotential lines and is operated at a lower voltage, corresponding to the field potential at the point of insertion of the beam. Its aperture diameter is chosen to pass the portion of the laminar flow beam required to provide a uniform beam current distribution over the surface of electrode $A_2$ while intercepting a significant portion of the total current. In the case illustrated, 89% is intercepted resulting in a decrease in power at electrode $A_2$ to only 4.2 watts. The power at electrode $A_1$ is dependent on its voltage, which in turn depends on its interelectrode spacing.

This approach suggests that other variables, such as cathode diameter and spacings between the cathode and anodes could be adjusted to lower values. However, the chosen emitter diameter of 0.030 inch represents a practical minimum size for the long-life, high current density cathode required for the light valve. Considering the beam spread angle is inversely related to the axial velocity (and anode voltage), a voltage in the +7000 to +8000 volt range is needed for electrode $A_2$ to achieve a calculated beam spread of less than 0.6 total included angle. Additionally, lower voltages increase the gun's sensitivity to undesirable magnetic field effects. Accordingly, the optimum design parameters for this new electron gun involve trade-offs between cathode temperature, accelerating voltages, field and beam shaping electrodes and apertures, beam edge scraping, laminar flow and beam spread field factors, power dissipation, mechanical, magnetic and electrical system sensitivity, and gun current stability under time varying gun conditions in the light valve environment.

Figure 6C:
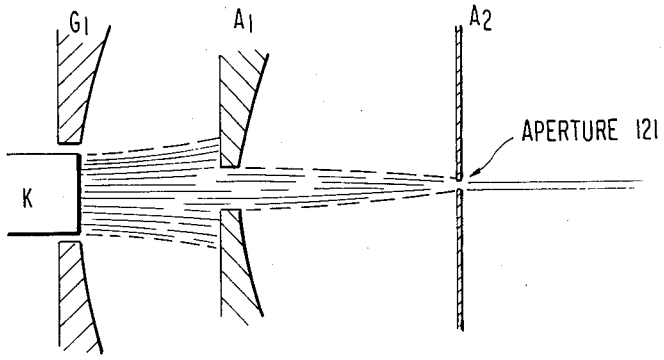

Starting with a 0.030 inch diameter cathode and considering the general principles and parameters detailed above, a new laminar flow gun system was developed. Analysis of the beam current controlling electrostatic fields between electrodes $A_1$ and $A_2$, grid $G_1$, and cathode K as illustrated in FIGS. 6B and 6C shows that a set of interelectrode spacings and $A_1$ aperture diameters can be chosen so that the $A_2$ to $G_1$ and K positive field penetration through the $A_1$ aperture can be just balanced by the $G_1$ and K to $A_1$ negative field, maintaining the desired laminar flow through the aperture. However, when beam current must be controlled, a decrease in $A_1$ voltage which would decrease the current, decreasing the current density in the aperture area of $A_1$, is countered by the increased field strength between $A_1$ and $A_2$, refocusing the beam toward the $A_2$ aperture and restoring the beam density to its previous level, albeit with some slight increase in beam angle. This example illustrates how this gun design can be made relatively insensitive to some voltage changes. On the other hand, when one needs to decrease the electron beam current through electrode $A_2$, an increase in grid $G_1$ negative potential will change the $G_1-K$ to $A_1$ field and tend to increase the beam current density through the aperture $A_1$ largely self-defeating the modulating signal; an undesirable characteristic.

Figure 6D:
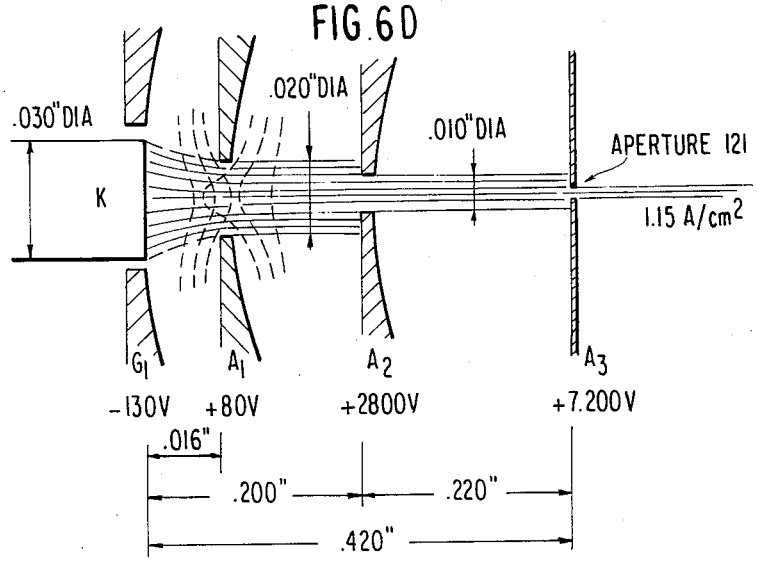

A further development of this electron gun is shown in FIG. 6D. In this embodiment, a third apertured electrode is added, further decreasing the power requirements of the gun, enhancing the modulation capability and decreasing the change in beam angle of the writing beam as a function of current controlling voltages. This electron gun is shown with a cathode K, a grid G, and a first apertured electrode $A_1$, which operates at a low positive potential to establish the desired emitter current density and partially isolate the cathode K from the fields of electrodes $A_2$ and $A_3$. Apertured electrode $A_2$provides the same laminar flow focusing and beam scraping function as in the gun of FIG. 6C but its input beam focusing field is largely effective between electrodes $A_1$ and $A_2$ rather than between $A_1$ and K. Anode $A_3$ supports aperture 121 and receives the uniform current density laminar flow electron beam which is then shaped by that aperture to the desired rectangular cross section and emerges as a beam having a very low beam spread angle as it enters the light valve. The electron beam current through this gun can be controlled by adjusting the laminar flow current density at the beam shaping aperture plane to the desired value, with a minimal change in transverse electron velocities, thus retaining the desired minimal beam spread. This multi-anode design also uses electron emission from the full active cathode area by providing a series of field producing apertured electrodes which have decreasing aperture sizes as distance from the cathode is increased. The interaction of successive electron lenses to establish laminar flow, combined with beam edge interception at the lower voltages than the $A_3$ potential, provides excellent electrical and mechanical stability, as well as relative freedom from magnetic field interference with the beam at the anode $A_3$ plane. Although a control grid $G_1$ is shown in FIG. 6D, its inclusion in the laminar flow gun is optional. A non-emitting extension of the cathode electrode could provide an appropriate $A_1-K$ field defining electrode. Alternatively, the $G_1$ electrode can be modulated with negative going pulses to cut off the beam in response to video or projecter control voltages where this is wanted.

Figure 7:
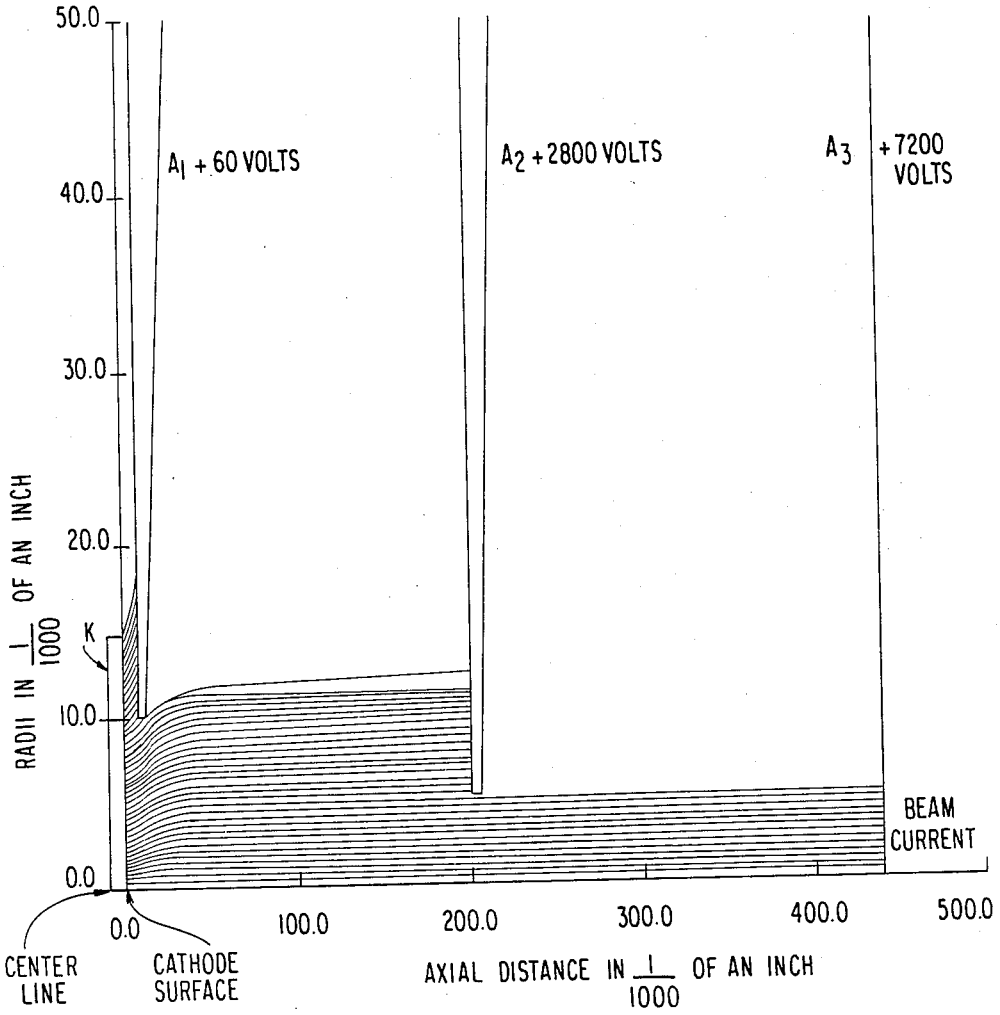
FIG. 7 is a graph which shows a ray trace analysis of electron beam laminar flow conditions achieved by the electron gun according to the invention.

FIG. 7 illustrates electron beam ray trajectories for one embodiment of this laminar flow gun and shows the effect of the progressively decreasing aperture sizes of the anode structure. The case is computed for an electron gun having a 0.030 inch diameter cathode emmiter with a work function of four electron volts, operating in the space charge limited mode, with K to $A_1$ spacing of 0.012 inches and an aperture diameter of 0.020 inches. $A_1$ to $A_2$ spacing is 0.188 inches, while the $A_2$ to $A_3$ spacing is 0.220 inches and the $A_3$ rectangular aperture, 121, is 0.00035 inches by 0.0018 inches. This design of the gun does not use a control grid electrode. The beam current density is 1.15 amperes/cm$^2$ when $A_1$ is +60 volts, $A_2$ is +2800 volts and $A_3$ is +7200 volts, where all voltages are with respect to the cathode, K, potential. For purposes of this calculation, a Maxwellian distribution of electron emmision initial velocities was assumed with a lambertian distribution of velocity vectors from the cathode surface. The laminar flow of the electron beam at the imaging aperture is evidenced by the ray traces shown.

Figure 8:
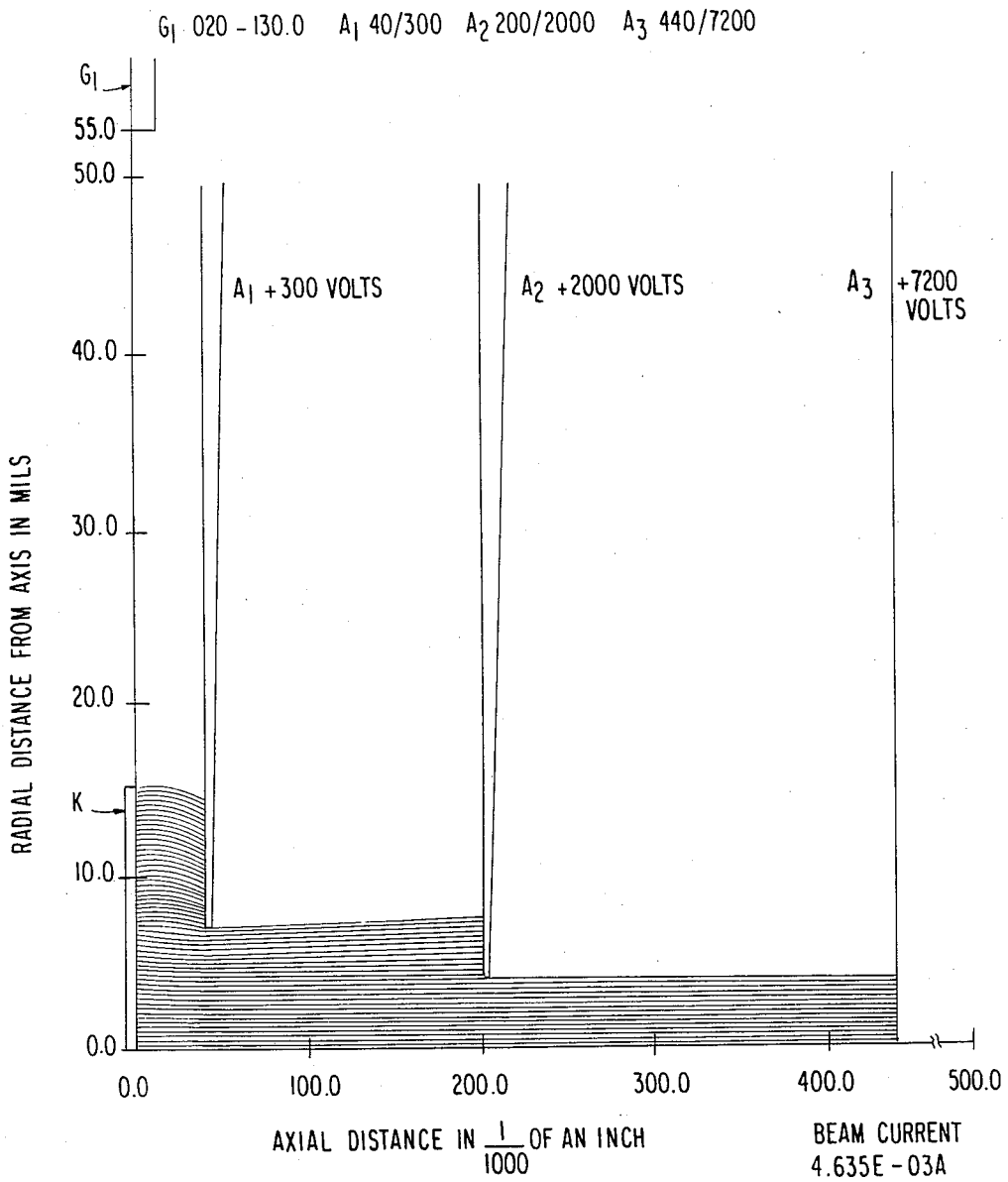
FIG. 8 is a graph which shows a ray trace analysis of electron beam laminar flow conditions achieved by a second design according to the invention.

FIG. 8 illustrates electron beam ray trajectories for a second embodiment of this laminar flow gun design, again illustrating the effect of progressively decreasing aperture sizes of the electrode structures. The case is computed for an electron gun having a control grid, $G_1$, with a 0.110 inch diameter aperture and whose surface plane is 0.020 inches ahead of the cathode surface, a 0.030 inch diameter cathode, K, with a work function of four electron volts, operating in the space charge limited mode, with a K to $A_1$ spacing of 0.040 inches, an $A_1$ aperture diameter of 0.016 inches, and $A_1$ to $A_2$ spacing of 0.160 inches, and A aperture diameter of 0.010 inches, an $A_2$ to $A_3$ spacing of 0.220 inches, and an $A_3$ rectangular aperture of 0.00035 inches by 0.0018 inches. The beam current density is 1.15 amperes/cm$^2$ when $G_1$ is −130 volts, $A_1$ is +300 volts, $A_2$ is +2000 volts, and $A_3$ is +7200 volts, where all voltages are with respect to the cathode, K, potential. As in the case of the gun represented in FIG. 7, a Maxwellian distribution of initial velocities of emitted electrons was assumed with a lambertian distribution of velocity vectors from the cathode surface. The laminar flow is evidenced by the ray traces show.

The use of three accelerating electrodes with critical axial spacing to beam diameter ratios allows independent adjustment and/or modulation of beam current density at the object aperture while reducing criticality of electrode voltages on the second and third accelerating electrodes. The first accelerating electrode being closely spaced to the cathode produces a virtual cathode at, or about, the voltage level of that electrode, and this reduces the thermal beam spread normally encountered in conventional electron guns. Primary control of the narrow angle beam current is by adjustment of the beam current density impinging on the final aperture in the gun. The interaction of negative and positive electron lenses within the gun retains the laminar flow conditions to the final aperture over a wide range of beam current levels, thereby assuring low beam spread in the output beam from the gun.

Figure 9:
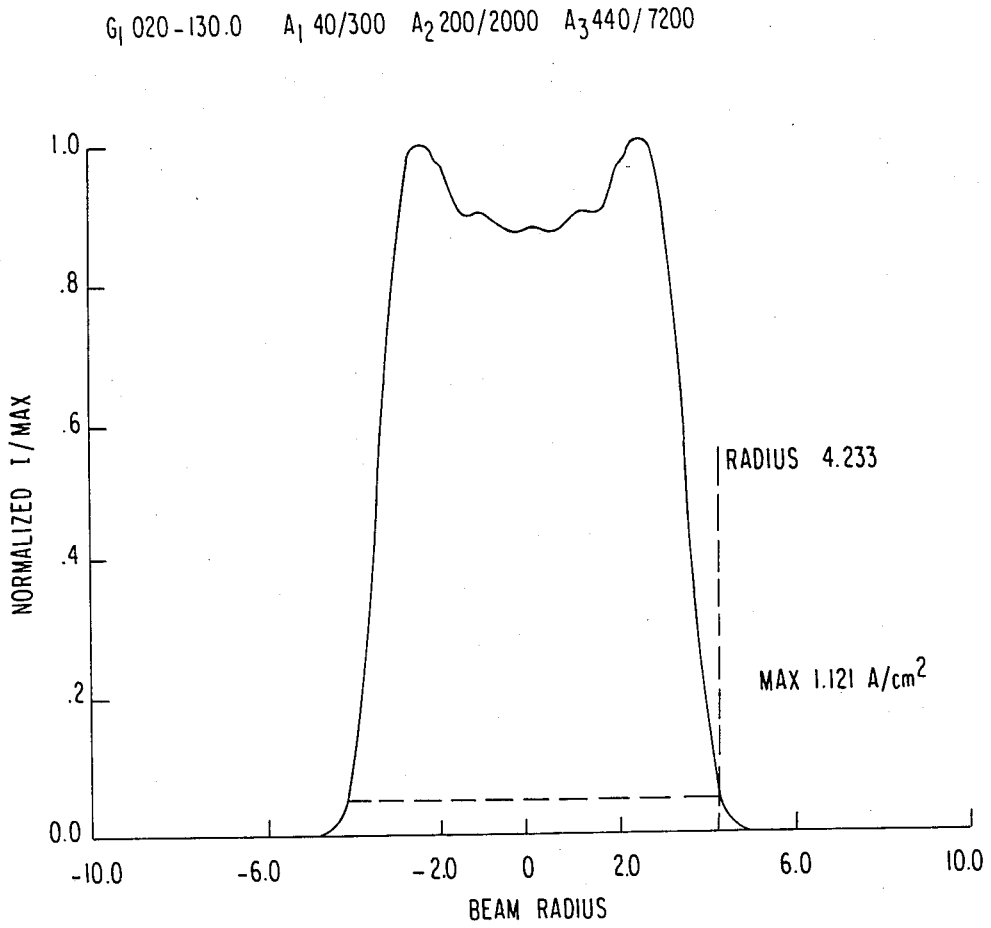
FIG. 9 is a graph showing beam current densities achieved with the electron gun according to the invention.

FIG. 9 is a graph of the beam current density of the electron beam generated by the laminar flow electron gun of the invention, having a grid (as described above), at different radial positions at the $A_3$ aperture plane.

While the invention has been described in terms of a specific preferred embodiment, those skilled in the art will recognize that the invention can be practiced with modification and alteration within the scope and spirit of the appended claims. For example, cathodes capable of the desired current density emission could be operated over a temperature range of 1200 to 3000° K. and anode voltages and spacings can be adjusted to meet required conditions while maintaining the laminar flow and desired low beam angle.

Having thus described my invention, what we claim as new and desire to secure by Letters Patent is as follows:

1. A laminar flow electron gun for a light valve of the Schlieren dark field type comprising:

a cathode which operates at a temperature of about 2000° K. to provide an electron beam having a current density of about 1.2 amperes/cm$^2$;

a first electrode having an aperture that is axially aligned with and closely spaced to said cathode and operated at a small positive voltage with respect to said cathode, said cathode and said first electrode forming a virtual cathode at or about the potential of said first electrode to reduce the effect of thermal spreading of said electron beam;

a second electrode having an aperture that is axially aligned with and spaced from said first electrode and operated at a relatively high positive potential with respect to said cathode, said second electrode having an aperture area smaller than the aperture area of said first electrode; and a third electrode having an aperture and axially aligned with the spaced from said second electrode and operated at a potential higher than said second electrode, said third electrode having an aperture area smaller than the aperture areas of said first and second electrodes, each of said first, second and third electrodes intercepting portions and transmitting portions of said electron beam to establish the laminar flow thereof.

2. The electron gun recited in claim 1 wherein the third electrode aperture is rectangular.

3. The electron gun recited in claim 1 wherein said cathode has a diameter of about 0.030 inch and the spacing between said cathode and said first electrode is on the order of 0.012 to 0.080 inches.

4. The electron gun recited in claim 3 wherein the spacing between said first and second electrodes is approximately 0.188 inch, the spacing between said second and third electrodes is approximately 0.22 inch, the diameter of the aperture of said first electrode is approximately 0.02 inch, the diameter of the aperture of said second electrode is approximately 0.01 inch, said first electrode is operated at a potential range from +40 to +80 volts, said second electrode is operated at a potential range of +2000 to +3000 volts and said third-electrode is operated at a potential of about +7200 volts.

5. An adjustable current, laminar flow electron gun comprising a flat cathode, grid and at least two accelerating anodes, the accelerating anode farthest from said cathode having a beam shaping aperture, said grid and said accelerating anodes being on a common axis with said cathode, each of said accelerating anodes having successively smaller area apertures in a direction away from said cathode, said accelerating anodes being connectable to a source of potential to create electrostatic fields that cause electrons to move from the cathode through the electron gun in an essentially laminar flow with minimum spread in an electron beam passing through said beam shaping aperture, said beam shaping aperture being electron optically imaged on a target.

6. The electron gun recited in claim 5 wherein there are three accelerating anodes.

7. The electron gun recited in claim 5 wherein the beam shaping aperture is rectangular.

8. The electron gun recited in claim 5 wherein said cathode operates at a temperature range of 1200° to 3000° K. to provide a current density of up to 4 amperes/cm$^2$.

9. The electron gun recited in claim 8 wherein the first accelerating anode and said cathode are closely spaced, said first accelerating anode being operated at a small positive voltage with respect to said cathode, said cathode and said first accelerating anode forming a virtual cathode at or about the potential of said first accelerating anode.

10. The electron gun recited in claim 9 wherein there are three accelerating anodes, the second accelerating anode being operated at a relatively high potential with respect to said cathode, and the third accelerating anode with said beam shaping aperture being operated at a potential higher than that of said second accelerating anode.

11. The electron gun recited in claim 10 wherein said beam shaping aperture is rectangular.

* * * * *